United States Patent [19]

Chilton

[11] Patent Number: 4,630,347

[45] Date of Patent: Dec. 23, 1986

[54] HYDRANT VALVE TOOL

[76] Inventor: James E. Chilton, 9409 Shady Valley, Dallas, Tex. 75238

[21] Appl. No.: 757,654

[22] Filed: Jul. 22, 1985

[51] Int. Cl.[4] ..... B25B 17/00

[52] U.S. Cl. ..... 29/213 R

[58] Field of Search ..... 81/57, 39; 29/213

[56] References Cited

U.S. PATENT DOCUMENTS

| | | | |
|---|---|---|---|
| 694,298 | 2/1902 | O'Brien . | |
| 2,116,770 | 5/1938 | Scillia | 137/13 |
| 2,961,904 | 11/1960 | Sergan | 81/60 |
| 4,027,561 | 6/1977 | Junkers | 81/57.39 |
| 4,086,830 | 5/1978 | Latham | 81/57.39 |
| 4,092,881 | 6/1978 | Jurgens et al. | 81/57.34 |
| 4,178,816 | 12/1979 | Radice | 81/57.3 |
| 4,398,598 | 8/1983 | Fabrygel | 81/57.39 |

*Primary Examiner*—Robert C. Watson

*Attorney, Agent, or Firm*—Hubbard, Thurman, Turner & Tucker

[57] ABSTRACT

A hydrant tool assembly for installing or removing a seat ring and valve from a hydrant shoe located beneath a hydrant and including a valve cap structure that mates with the valve and extends through a top portion of the hydrant. A hydraulic apparatus is provided that is attachable to the top portion of the hydrant for providing a torquing force to the valve cap structure. Further, a lever structure is provided that is attachable to the hydraulic structure for enabling leveraged manual turning of the valve cap structure to supplement the hydraulic torquing of the valve cap structure.

15 Claims, 2 Drawing Figures

HYDRANT VALVE TOOL

BACKGROUND

1. Field of the Invention

This invention relates to tools used to replace and install hydrant plumbing and more specifically to tools used to replace and install hydrant valves located underneath the ground and attached to a water main.

2. Description of Related Information

Fire hydrants are a common fixture in most municipal water distribution systems and provide for ease of access to water contained in underground water lines. Fire hydrants provide for a plumbing attachment to these underground water lines. The common fire hydrant includes two parts; an upper barrel and a lower barrel, whereby the lower barrel is connected to a shoe which is attached to the water main. A valve is located in the shoe to provide a control of water through the hydrant lower barrel up to the upper barrel where water hoses may be attached. The valve in the shoe is threaded to mate with complimentary threads in the shoe. Therefore, to install and remove the valve one must turn the valve into and out of the shoe. These valves include components that wear the time resulting in the requirement that valves must be replaced. After several years, it is common for these valves to be difficult to remove. In addition, the location of the valve in the shoe which is normally five to ten feet below the surface of the ground makes the removal and installation more difficult.

Several attempts have been made to provide tools to aid in the removal of the valve. One early attempt is disclosed in U.S. patent application No. 694,298 which discloses a tool to remove the hydrant valve. A more recent hydrant tool is disclosed in U.S. Pat. No. 4,178,816 entitled "Portable Hydrant Wrench".

As object of the present invention is to provide means to remove a hydrant valve located beneath the ground without having to excavate the water main shoe.

A further object of the present invention is to provide hydraulic means to assist a tool operator in removing hydrant valves.

A still further object of the present invention is provide a hydrant tool that includes both hydraulic means and provides for manual means for removing and installing hydrant valves.

SUMMARY OF THE INVENTION

In accordance with the present invention a hydrant tool assembly is provided for removing a valve from a water main shoe located beneath a hydrant. The tool assembly includes a valve cap structure that mates with the seat ring which holds the valve and extends through a top portion of the hydrant. A hydraulic apparatus is provided that is attached to the top portion of the hydrant and provides a torque force to the valve cap structure. A lever apparatus is also provided that is attachable to the hydraulic apparatus that enables a leveraged manual turning of the valve cap structure.

In one embodiment of the present invention, the hydraulic tool assembly includes a valve cap that mates with the seat ring and valve which is located beneath the surface over the ground in the water main shoe. The valve cap is connected to an extension tube that is rectangular in shape and is provided to fit over a valve rod, such that the valve rod need not be removed to remove the valve. A jack table is provided that is attachable to the top portion of the hydrant by a series of bolts. The jack table includes openings for inserting these bolts in a manner to align the jack table with a predetermined angular relationship with the rectangular extension tube. In this embodiment, a breaking bar is also provided to be attached to the extension tube above the jack table. The breaking bar extends outwardly across the jack table. The jack table further includes openings to receive hydraulic jacks that can be placed at corner positions of the jack table to engage the extended portions of the breaking bar. In this manner, the hydraulic jacks when attached to the jack table and engaging the breaking bar may impart a torque on the breaking bar and thus on the extension tube and valve cap. The breaking bar further includes a structure to receive lever bars or "cheater bars" that may be attached to the breaking bar and, upon the removal of the hydraulic jacks, enable manual turning of the breaking bar, extension tube and valve cap for valve removal.

In a further enhancement of this invention, a gripper assembly is provided that includes two double C shaped pieces containing sawtooth interior portions whereby the two double C shaped structures may be applied to the base of the upper barrel of the hydrant and the top portion of the lower barrel of the hydrant and bolted together to insure that the upper barrel and lower barrel do not move relative to each other as the turning or torquing forces are being applied to the extension tube.

Also, a further enhancement includes a rotor that is placed on an opening of the jack table that receives the extension tube. This rotor encloses the extension tube and rests upon the jack table and underneath the breaking bar elevating the breaking bar such that the breaking bar will be free to rotate about the jack table after the removal of the hydraulic jacks.

BRIEF DESCRIPTION OF THE DRAWINGS

The novel features believed characteristic of the invention are set forth in the claims. The invention itself, however, as well as other features and advantages thereof will be best understood by reference to the detailed description which follows when read in conjunction with the accompanying drawings wherein:

DETAILED DESCRIPTION OF THE PREFERRED EMBODIMENT

The purpose of this invention is to provide a hydrant tool to enable the removal of a hydrant valve that is commonly located beneath the ground in a hydrant shoe attached to the water main. If the valve cannot be removed from the surface, the entire hydrant assembly must be removed and replaced by excavation. Such excavation is very expensive and time consuming.

Figure 1A:
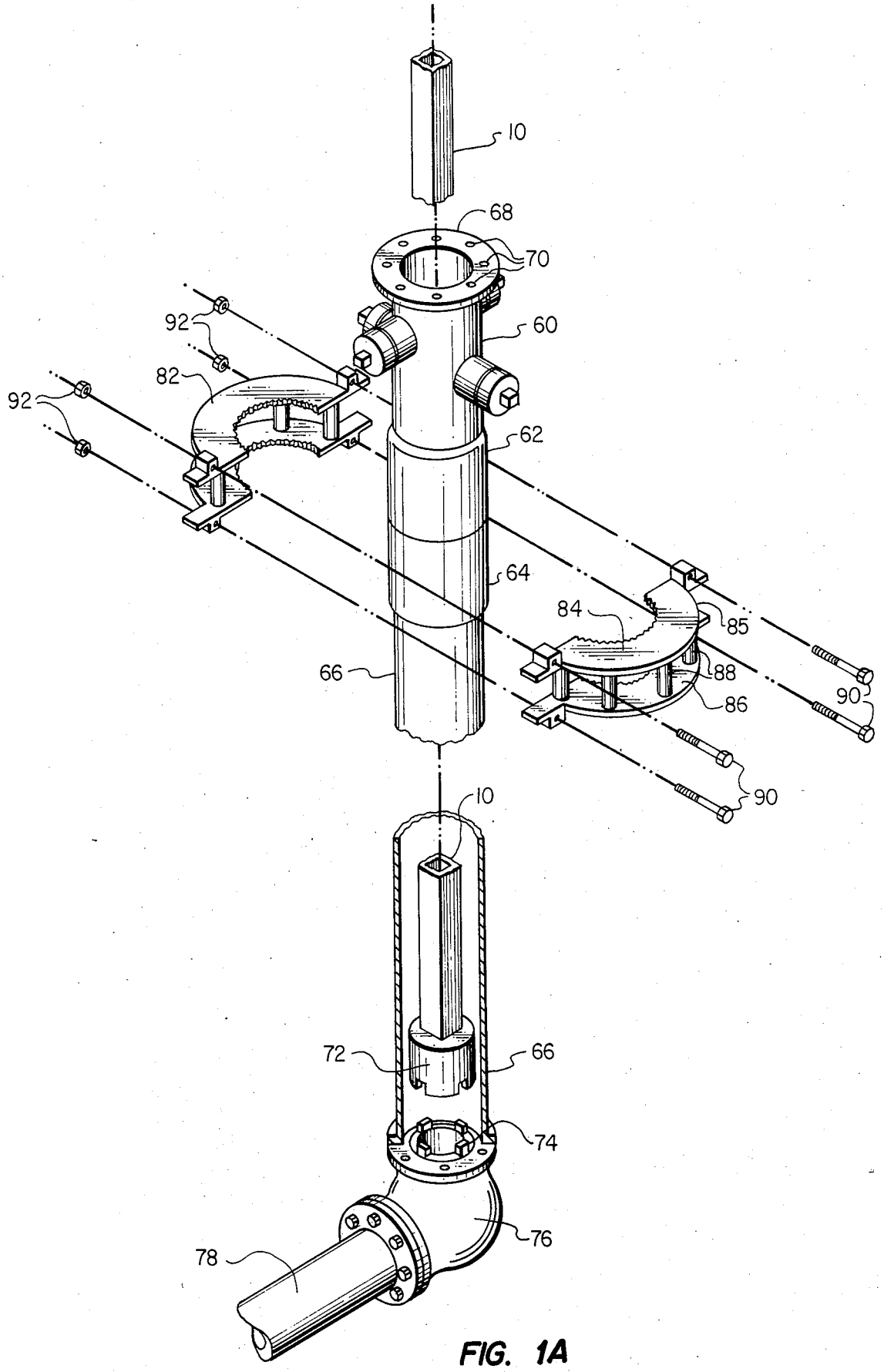
FIG. 1A is an isometric and partially sectional view of the fire hydrant and valve structure illustrating the gripper clamp, valve cap and extension bar.

FIG. 1A is an exploded view illustrating the lower portion of the hydrant tool and the hydrant structure. The water main 78 is commonly connected to a hydrant shoe 76 which includes a valve including an interior valve seal, valve plate and top portion (all not shown) connected to a valve ring 74 which seats in shoe 76. The attachment of the valve ring is commonly accomplished by providing threads complimentary to threads provided in the hydrant shoe 76 such that the valve ring 74 may be screwed into the hydrant shoe 76. The hydrant shoe 76 is also bolted to the lower barrel 66 of the fire hydrant which extends upwardly above the ground level to the fire hydrant upper barrel 60.

In the hydrant illustrated, the lower barrel 66 includes a flange portion 64 which fits into a flange portion 62 of the upper barrel 60. This is often provided to permit the separation of the upper barrel 60 from the lower barrel 66 with a small degree of force if the hydrant should be hit by an automobile. The valve located in the hydrant shoe 76 is connected by a valve rod (not shown) that extends upward to the fire hydrant bonnet (or dome portion of a fire hydrant) not shown. The fire hydrant bonnet includes a bolt head upon its surface that permits an operator to turn the valve rod and thus operate the valve below the ground.

This invention includes an extension tube 10 of rectangular shape that includes a valve cap 72 located on one end. The rectangular shaped tube 10 fits over and surrounds the valve rod and is lowered onto the seat ring 74. FIG. 1A further illustrates a gripper clamp consisting of two double C sections 82 and 84. C section 84 consists of an upper C plate 85 connected to a lower C plate 86 by vertical standoffs 88. The C sections terminate in structures that receive bolts 90 as shown. Furthermore, plates 85 and 86 include a sawtoothed interior portion for gripping against the flange sections of the upper barrel 60 and lower barrel 66. When C sections 82 and 84 are placed about the upper and lower flanges 62 and 64 as shown, bolts 90 are connected with nuts 92 to fasten the two C sections 82 and 84 together resulting in the clamping of the two flange sections 62 and 64 as shown and effectively locking the upper 60 and lower 66 barrels together.

In another type of fire hydrant, the flange sections 62 and 64 are replaced by flange sections that bolt together. In that case a gripper clamp is not required since the bolts of the hydrant clamp the upper barrel 60 to the lower barrel 66.

The extension bar 10 then extends from the top portion of the fire hydrant upper barrel 60 when the valve cap 72 has been positioned on the seat ring 74. In FIG. 1A, the bonnet portion of the fire hydrant has been removed exposing a top flange 68 that includes several bolt holes such as 70.

Figure 1B:
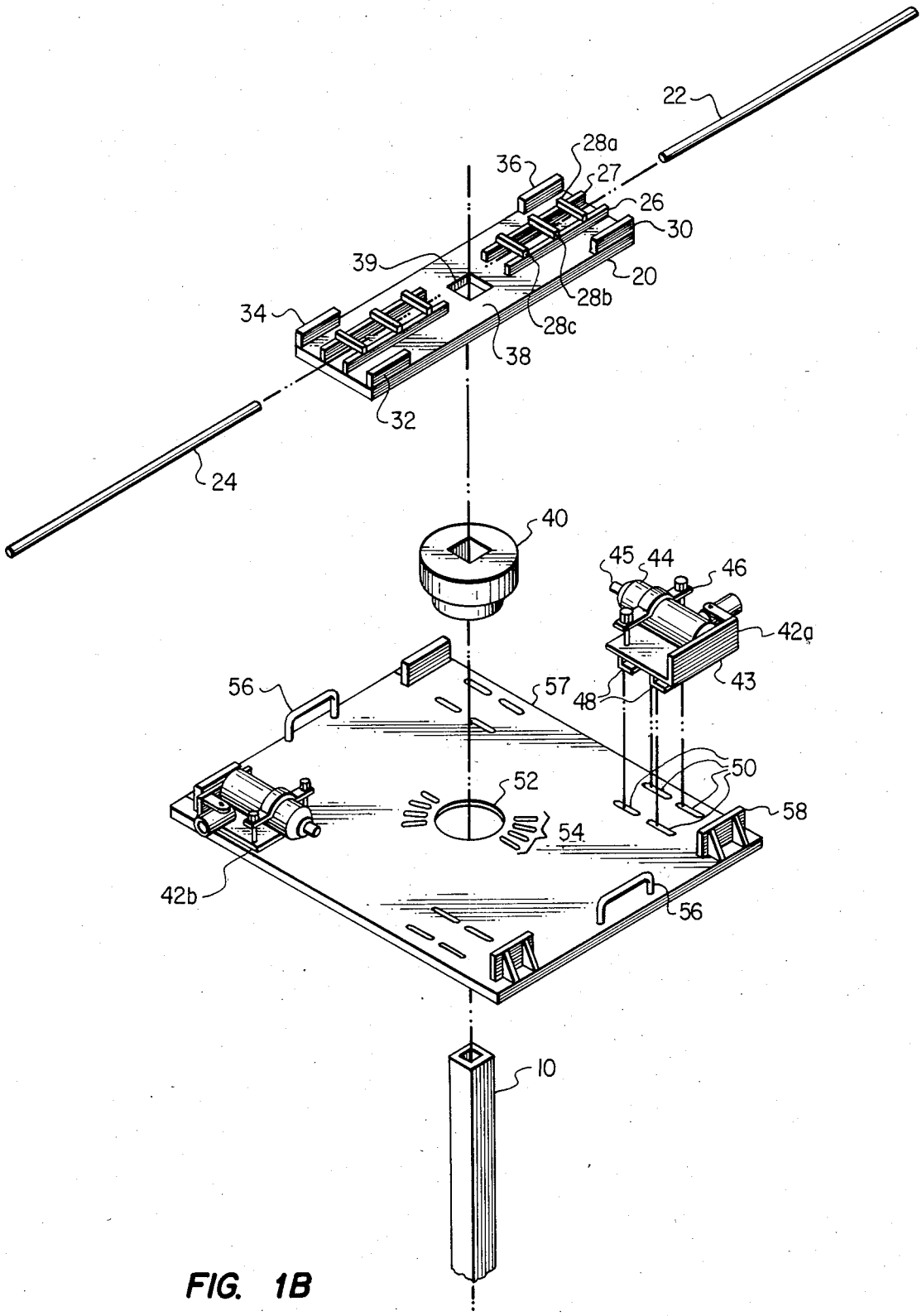
FIG. 1B is an isometric exploded view of the extension bar, jack table, rotor and breaking bar.

In FIG. 1B, the jack table 57 is placed over the hydrant flange 68 wherein the extension tube 10 extends through an opening 52 in jack table 57. Holes 54 are provided to enable the jack table to be secured to flange 68 by inserting bolts into holes 54 and connecting holes 70 of the hydrants upper barrel 60 to fasten the jack table 57 at an angular relation to the extension tube 10.

Once the jack table 57 has been bolted to the fire hydrant upper barrel 60, a rotor 40 is installed over the extension tube 10 into opening 52, thus preventing any lateral movement of the extension tube 10 in the opening 52.

A breaking bar 20 is installed over the extension tube wherein the extension tube extends through an opening 39 in the breaking bar plate 39. The breaking bar 20 then rests on rotor 40 with the extending tube 10 extending through opening 39. Breaking bar 20 includes reinforced sections 30, 32, 34, and 36 that have been welded to the breaking bar plate 38. Breaking bar 20 further includes a structure consisting of side members 26 and 27 connected by crossbars 28A, 28B and 28C to be discussed later.

With the breaking bar in place, hydraulic jack assemblies 42A and 42B are placed on jack table 57. The hydraulic jack assemblies 42A and 42B are virtually identical and only assembly 42A will be discussed. Assembly 42A consists of a L-shaped plate 43 that includes four hook structures 48 located on the underside of the plate 43. A conventional hydraulic jack 44 rests in plate 43 and is held in place by a C clamp 46 bolted as shown. The hydraulic jack 44 and jack plate 43 thus may be easily attached by hooks 48 through openings 50 to the jack table 57. When both hydraulic jack assemblies 42A and 42B are in place, the hydraulic jack is operated to engage the breaking bar 20. The hydraulic jack rod 45 would engage the breaking bar 20 on reinforcing plate 30 in this example. Both hydraulic jacks are then operated to impart a torquing force onto extending tube 10. This torquing force is transmitted to the valve cap 72 and seat ring 74 to unscrew the seat ring 74 from shoe 76. The counter torque placed upon the jack table 57 is absorbed through the upper barrel 60 and through the gripper clamps 82 and 84 to the lower barrel 66. Therefore, the purpose of the gripper clamps 82 and 84 is to prevent the hydraulic jack generated torque from twisting the upper barrel 60 relative to the lower barrel 66.

It should be appreciated that the use of the hydraulic jack assemblies 42A and 42B enable an operator to produce a relatively large torquing action on the seat ring 74 enabling the operators to unscrew a well seated seat ring.

After the valve ring initially "breaks", i.e. unscrews, the hydraulic jack assemblies 42A and 42B are removed from the jack table and lever bars or "cheater bars" 22 and 24 are inserted into the breaking bar 20. These lever bars 22 and 24 enable operators to manually turn the seat ring 74 for removal.

It should be understood by those skilled in the art, that the locations of jack assemblies 42A and 42B may be changed on the jack table to provide for installation of a seat ring 74 in a hydrant shoe 76.

Although preferred embodiments of the invention have been described in detail, it is to be understood that various changes, substitutions and alterations can be made therein without departing from the spirit of the invention as defined by the appended claims.

What is claimed is:

1. A hydrant tool assembly for removing or installing a seat ring and a valve from a hydrant shoe located beneath a hydrant, said tool assembly comprising:

valve cap means including a rectangular extension bar for mating with said seat ring and extending through a top portion of the hydrant;

hydraulic means attachable to the top portion of the hydrant for providing a torque force to the valve cap means; and lever means attachable to the hydraulic means for enabling leveraged manual turning of the valve cap means.

2. A hydrant tool assembly according to claim 1 wherein said hydraulic means includes at least one hydraulic jack attachable to a jack table which is attachable to the top portion of the hydrant.

3. A hydrant tool assembly according to claim 2 wherein said hydraulic means further includes a breaking bar extending from the valve cap means to engage the hydraulic jack.

4. A hydrant tool assembly according to claim 3 wherein said lever means includes at least one lever bar engageable with the breaking bar.

5. A hydrant tool assembly for removing or installing a valve into a hydrant shoe located beneath a hydrant, said tool assembly comprising:

a valve cap means including a rectangular extension bar for mating with said valve and extending from said valve;

a jack table attachable to a top portion of the hydrant and including an opening for receiving the extended valve cap means;

a breaking bar attachable to the valve cap means and positionable upon the jack table;

hydraulic means attachable to the jack table for providing a torque force to the breaking bar; and lever means attachable to the breaking bar for enabling leveraged manual turning of the breaking bar.

6. A hydrant tool assembly for installing or replacing a valve into a hydrant shoe beneath a hydrant, said hydrant tool assembly comprising:

a valve cap formed to mate with the seat ring and valve;

a rectangular extension tube including an opening permitting a valve rod to be located therein, and connected at one end to the valve cap and extending through a top portion of the hydrant;

a jack table attachable to the top portion of the hydrant and including a circular opening for receiving the extension tube;

a rotor located upon the jack table opening and engaging the tube;

a breaking bar located upon the rotor and engaging the tube, said breaking bar extending over the table and including at least one structure to receive a lever bar; and hydraulic means attachable to the table for providing a torque force to the breaking bar for turning the valve cap attached to the extension tube and removable from the table wherein the lever bar inserted into the breaking bar structure provides for leveraged manual turning of the valve cap and extension tube.

7. The hydrant tool assembly according to claim 6 further including a fastening device for fastening an upper barrel of the hydrant to a lower barrel of the hydrant.

8. A hydrant tool assembly according to claim 7 wherein said hydraulic means includes at least one hydraulic jack connected to a mount attachable to the jack table.

9. A hydrant tool assembly according to claim 8 wherein the rotor elevates the breaking bar above the jack table enabling the breaking bar to freely turn about the jack table upon removal of the hydraulic jacks.

10. A hydrant tool assembly according to claim 9 wherein the jack table includes a plurality of holes to permit the table to be fastened to the hydrant upper barrel at varied angular positions relative to the extension tube.

11. A hydrant tool assembly according to claim 10 wherein the jack table further includes handles located below the rotor elevation level to enable operators to transport the table.

12. A hydrant tool assembly according to claim 11 wherein said breaking bar includes reinforced surfaces for engaging the hydraulic jacks.

13. A hydrant tool assembly according to claim 12 wherein the jack table further includes braces for supporting the hydraulic jack assemblies when attached.

14. A hydrant tool assembly according to claim 13 wherein the jack mounts further include hooks for attachment to the jack table.

15. A hydrant tool assembly for removing or installing a valve into a hydrant shoe located beneath a hydrant, said tool assembly comprising:

A valve cap means including a rectangular extension bar for mating with said valve and extending from said valve;

a jack table attachable to a top portion of the hydrant and including an opening for receiving the extended valve cap means;

a breaking bar attachable to the valve cap means and positionable upon the jack table;

hydraulic means attachable to the jack table for providing a torque force to the breaking bar;

lever means attachable to the breaking bar for enabling leveraged manual turning of the breaking bar; and a fastening device for fastening an upper barrel of the hydrant to a lower barrel of the hydrant preventing any twisting of the upper barrel relative to the lower barrel when the torquing force is applied to the valve cap means.

* * * * *